US007413269B2

(12) United States Patent
Chen et al.

(10) Patent No.: US 7,413,269 B2
(45) Date of Patent: Aug. 19, 2008

(54) SYNCHRONOUS SYSTEM FOR A THREE-STAGE BALL BEARING SLIDE

(75) Inventors: Ken-Ching Chen, Kaohsiung Hsien (TW); Shih-Long Hwang, Kaohsiung Hsien (TW); I-Ming Tseng, Kaohsiung Hsien (TW); Chun-Chiang Wang, Kaohsiung Hsien (TW)

(73) Assignee: King Slide Works Co., Ltd., Kaohsiung Hsien (TW)

( * ) Notice: Subject to any disclaimer, the term of this patent is extended or adjusted under 35 U.S.C. 154(b) by 773 days.

(21) Appl. No.: 10/910,311

(22) Filed: Aug. 4, 2004

(65) Prior Publication Data

US 2006/0029304 A1 Feb. 9, 2006

(51) Int. Cl.
*A47B 88/00* (2006.01)

(52) U.S. Cl. ..... 312/333; 312/334.47

(58) Field of Classification Search ..... 312/333, 312/334.44–334.47; 384/21

See application file for complete search history.

(56) References Cited

U.S. PATENT DOCUMENTS 4,441,772 A * 4/1984 Fielding et al. ..... 312/330.1
4,549,773 A * 10/1985 Papp et al. ..... 384/18
4,560,212 A * 12/1985 Papp et al. ..... 384/18
5,551,775 A * 9/1996 Parvin ..... 312/334.11
5,757,109 A * 5/1998 Parvin ..... 312/334.11
6,367,899 B1 * 4/2002 Hwang et al. ..... 312/334.47
6,702,412 B2 * 3/2004 Dobler et al. ..... 312/334.5
6,749,276 B2 * 6/2004 Judge et al. ..... 312/334.47
6,935,710 B2 * 8/2005 Chen et al. ..... 312/333
6,945,619 B1 * 9/2005 Chen et al. ..... 312/334.47
6,962,397 B2 * 11/2005 Dobler et al. ..... 312/333
6,997,529 B1 * 2/2006 Chen et al. ..... 312/334.47
7,101,081 B2 * 9/2006 Chen et al. ..... 384/21
2002/0057042 A1 5/2002 Milligan
2003/0080659 A1 5/2003 Judge et al.
2003/0107309 A1 6/2003 Lauchner
2003/0111942 A1 6/2003 Judge et al.
2003/0178922 A1 9/2003 Chen et al.
2004/0201340 A1 * 10/2004 Chen et al. ..... 312/334.46
2005/0248247 A1 * 11/2005 Huang ..... 312/334.47
2006/0033408 A1 * 2/2006 Chiu ..... 312/333
2006/0244349 A1 * 11/2006 Chen et al. ..... 312/334.47
2007/0170830 A1 * 7/2007 Huang ..... 312/334.47

* cited by examiner

*Primary Examiner*—Janet M Wilkens
(74) *Attorney, Agent, or Firm*—Rosenberg, Klein & Lee

(57) ABSTRACT

A synchronous system for a three-stage ball bearing slide includes a carrier track being inserted into a fixed track to carry a mobile track. Both of the mobile and the carrier tracks engage in reciprocal movement along the same axis direction in relation to the fixed track. A dancer is pivoted to the rear end of the carrier track. The carrier track synchronously slides with the mobile track by a protruding tongue on the mobile track upholding the dancer, and is held in position by having the dancer to uphold a compression bit on the fixed track. A direct push on the extreme where the carrier track is extended releases the dancer from the compression bit to retract once again the carrier track into the fixed track.

7 Claims, 11 Drawing Sheets

SYNCHRONOUS SYSTEM FOR A THREE-STAGE BALL BEARING SLIDE

BACKGROUND OF THE INVENTION (1.) Field of the Invention

The present invention relates to a synchronous system for a three-stage ball bearing slide, and more particularly, to a mobile track when pulled to extend drives a carrier track to slide synchronously and is temporarily positioned at its terminal without being retracted thus to permit the carrier track to be directly subject to the push thereon to once again be retracted into a fixed track.

(2.) Description of the Prior Art

A conventional three-stage ball bearing slide usually contains a fixed track (outer track), a carrier track (middle track), and a mobile track (inner track). Taking the ball bearing slide adapted to a cabinet and its drawers for example, the fixed track (outer track) is fixed to the cabinet, the mobile track (the inner track) is each fixed to both sides of the drawer, and the carrier track (middle track) is inserted into the fixed track (outer track) by means of a slide aid, usually a ball bearing, to slide and carry the mobile track (inner track), thus to make the mobile track (inner track) and the carrier track (the middle track) engaging in reciprocal movement along the same axial direction in relation to the fixed track (outer track) for the drawer to be pulled out or in against the cabinet. The three-stage ball bearing slide of the prior as illustrated in FIG. 13 of the accompanying drawings defines the track according to its location. Slide aids D, E are respectively provided between the inner track (A) and the middle track (B) as well as between the middle track (B) and the outer track (C). A retainer (F) and a compressor (G) are respectively provided in the inner track (A) and the middle track (B) to allow one-way positioning when the inner track (A) is pulled out to its extreme and to pull the retainer (F) to release it from the compressor (G) for the inner track (A) to disengage from the middle track (B).

So far the development of the design of those ball bearing slides adapted to cabinets and drawers has been focusing on two purposes, to hold the carrier track (middle track) in positioning when pulled to its fully extended location, and to be pulled for movement synchronously with the mobile track (inner track). Design of the linking mechanism associated with those two purposes may be referred to U.S. Pat. Nos. 5,551,775 and 5,757,109; US Published Application Nos. 2002/0057042, 2003/0080659, 2003/0107309, and 2003/0111942; and Taiwan Utility Model Patent Nos. 215789 and 197034 (No. 197034 same as that of US Published Application No. 2003/0178922 owned by this Applicant).

SUMMARY OF THE INVENTION

The primary purpose of the present invention is to provide a synchronous system for a three-stage ball bearing slide, wherein, a mobile track when pulled to extend links a carrier track to slide synchronously and is temporarily positioned at its terminal without being retracted thus to permit the carrier track to be directly subject to the push thereon to once again retract into a fixed track.

To achieve the purpose, a dancer is pivoted to an arch surface of the rear end of the carrier track. The dancer is adapted with a plate in proper length flushed with the arch surface of the carrier track. An indention is formed on the rear of the plate and a wall facing the inner side of the mobile track is formed in front of the indention. A resisting bit facing the fixed track is provided behind the indention. Both of the wall and the resisting bit are facing each other and expanding outwardly at a certain oblique. A notch is provided in the rear of the carrier track to permit the insertion of the resisting bit of the dancer; and a hook is provided to the carrier track. The dancer keeps constant swing by having provided an elastic member connected between the hook and one side of a pivoted end of the dancer. A protruding tongue is provided on the inner side of the mobile track in relation to a space defined by the indention of the dancer, and a compression bit is provided on the inner side of the fixed track in relation to the rear end of the carrier track when pulled out. A shallow slot is provided on the edge of the compression bit in relation to the resisting bit of the dancer; thereby, the mobile track by extending its protruding tongue into the indention to hold against the wall, thus to link to and pull out the carrier track. The carrier track when pulled to its extreme is secured in position when the resisting bit of the dancer holds against the shallow slow of the compression bit to link the carrier track to be pulled out. Accordingly the positioning of the carrier track is released when subject to an externally applied push.

DETAILED DESCRIPTION OF THE PREFERRED EMBODIMENTS

Figure 1:
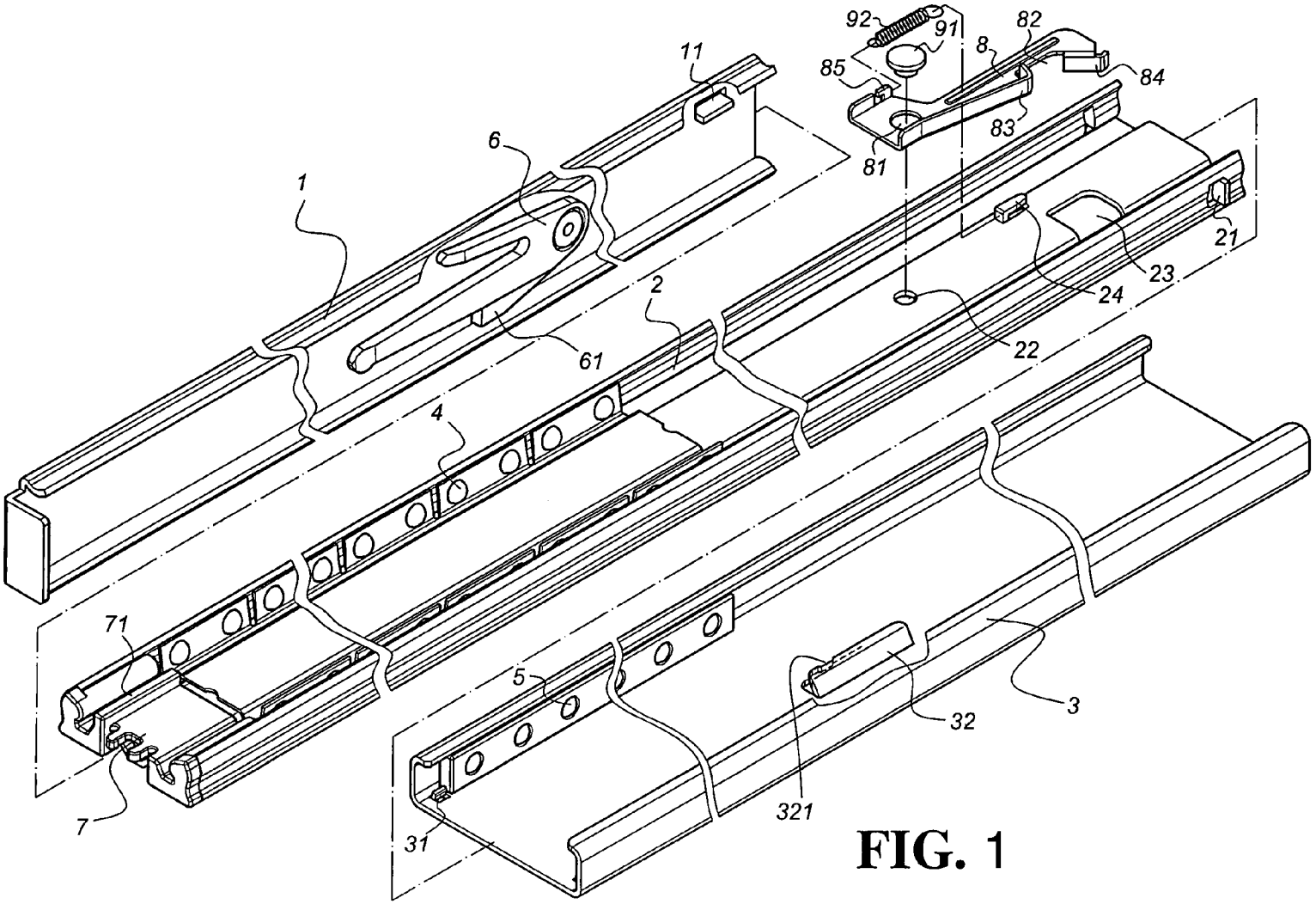
FIG. 1 is an exploded view showing a preferred embodiment of the present invention.
Figure 8:
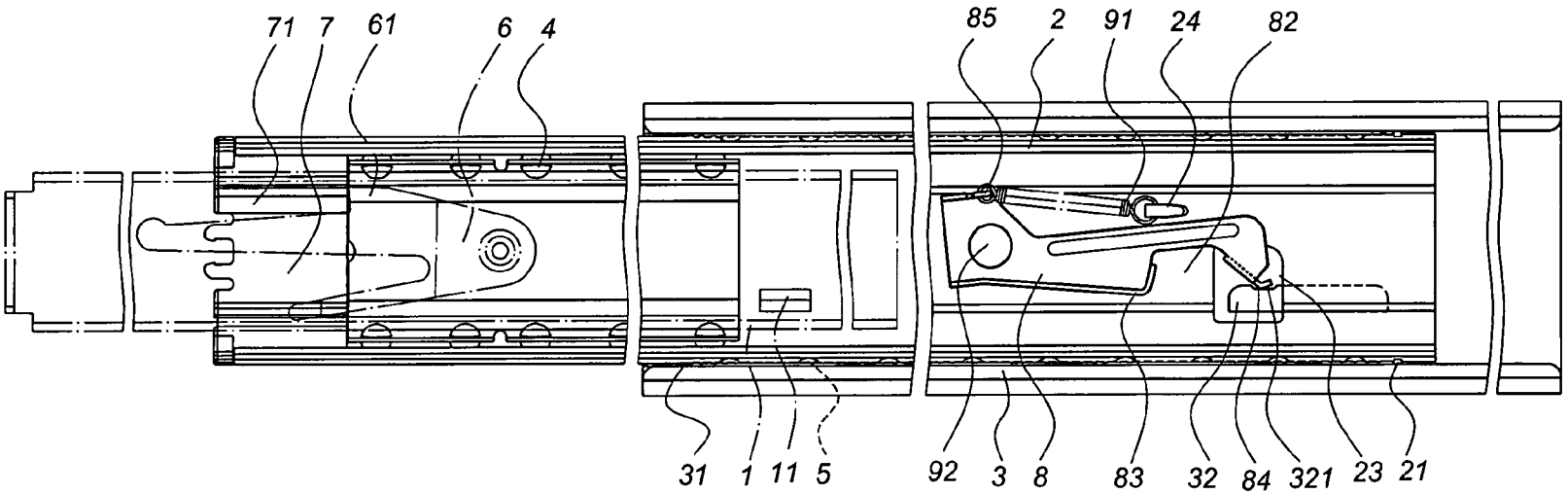
FIG. 8 is a schematic view showing the final state of the preferred embodiment of the present invention when fully extended.

Referring to FIG. 1, the present invention relates to a synchronous system for a three-stage ball bearing slide. The ball bearing slide adapted to a preferred embodiment of the present invention is essentially having respectively disposed two slide aids (4) and (5) between a mobile track (1) and a carrier track (2) as well as the carrier track (2) and a fixed track (3) to facilitate sliding. A retainer (6) and a compressor (7) are respectively disposed on the inner side of the mobile track (1) and the front end of the carrier track (2). A protrusion (61) is adapted to the lower side of the retainer (6) and a retaining bit (71) is provided on either side of the compressor (7). Accordingly, when the mobile track (1) is pulled to its extreme, the retainer (6) has its protrusion (61) to uphold the retaining bit (71) of the compressor (7) to prevent the mobile track (1) from disengaging from the carrier track (2). A stopper (21) is each provided on two sides at the rear end of the carrier track (2) and a raised piece (31) is each disposed on the inner sides at the front end of the fixed track (3) so that the carrier track (2) is retained by the slide aid (5) by means of the stopper (21) and the slide aid (5) is further retained by the raised piece (31) to restrict the extension extreme of the carrier track (2) in relation to the fixed track (3) as illustrated in FIG. 8. It is to be noted that the structures of preventing disengagement disposed for the mobile track (1) in relation to the carrier track (2), and for the carrier track (2) in relation to the fixed track (3) are not the primary claims to be claimed under this application, nor the adapted structures absolutely required in this application; therefore, shall not restrict the scope of the claims to be claimed hereunder.

The carrier track (2) in the preferred embodiment has an arch center in cross-section, and a dancer (8) is pivoted to the rear of the arch center. The dancer (8) contains a plate in proper length that is flushed on the arch center of the carrier track (2). A hole (81) is disposed at the front end of the plate to be inserted with a bolt (91) and riveted to a through hole (22) on the carrier track (2). An indention (82) is formed to the rear of the dancer (8) and a wall (83) facing the inner side of the mobile track (1) is formed in front of the indention (82). A resisting bit (84) facing the fixed track (3) is formed in the rear of the indention (82). The rear end of the wall (83) and the front end of the resisting bit (84) are facing each other and expanding outwardly at a certain oblique. A notch (23) is provided in the rear of the carrier track (2) to receive the insertion of the resisting bit (84) of the dancer (8). A hook (24) is provided on the carrier track (2) and a hanger (85) is formed on one side of a pivoted end of the dancer (8). An elastic member (92) is connected between the hook (24) and the hanger (85) to subject the dancer (8) to elastic pull for maintaining constant and automatic swing.

A protruding tongue (11) is provided on the inner side of the mobile track (1) in relation to the space defined by the indention (82).

A protruding compression bit (32) is disposed on the inner side of the fixed track (3) in relation to the rear end of the carrier track (2) when pulled out, and the edge of the compression bit (32) is provided with a shallow slot (321) in relation to the resisting bit (84) of the dancer (8).

Figure 2:
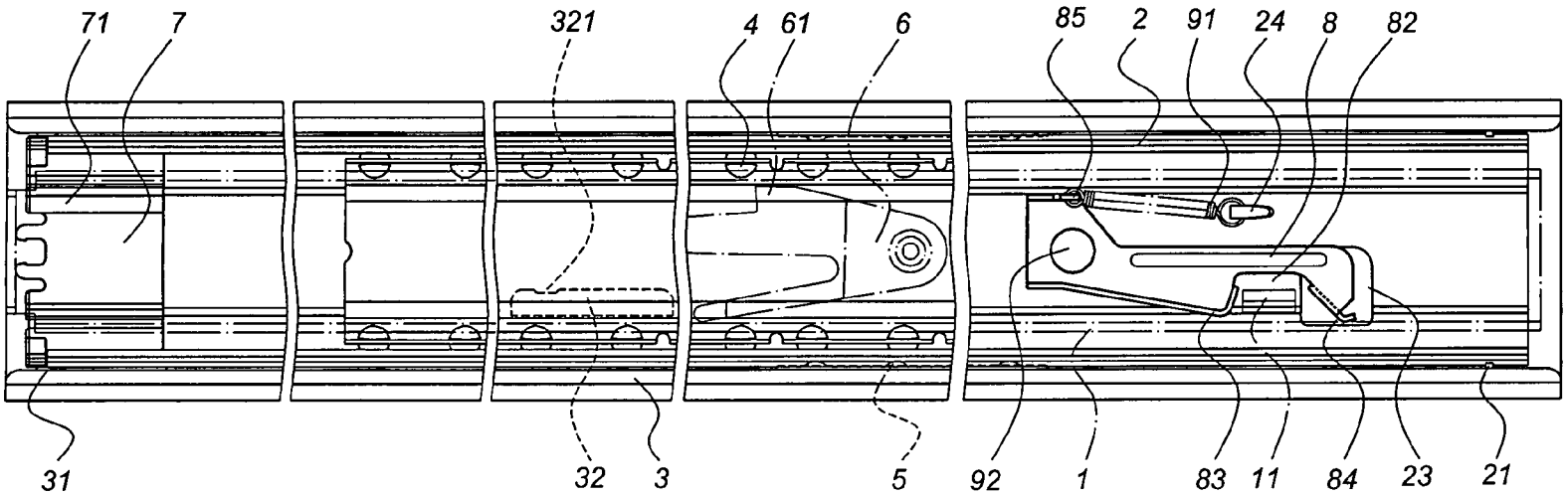
FIG. 2 is a top view showing an assembly of the preferred embodiment of the present invention.
Figure 3:
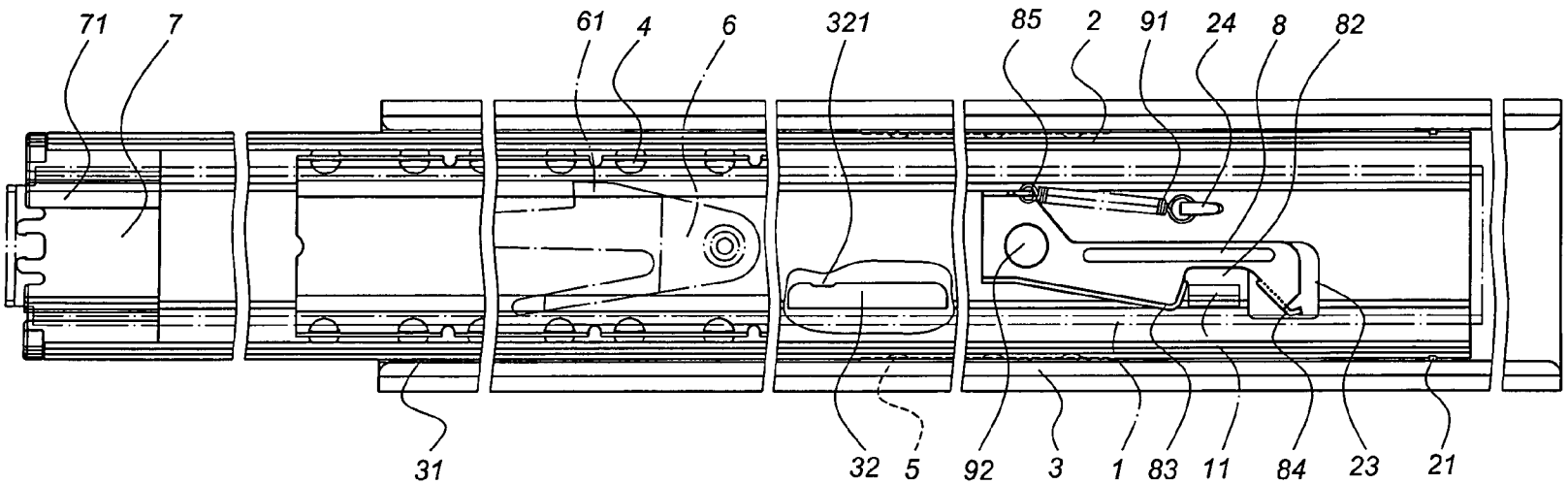
FIG. 3 is a first schematic view showing that the preferred embodiment of the present invention is pulled outwardly.
Figure 4:
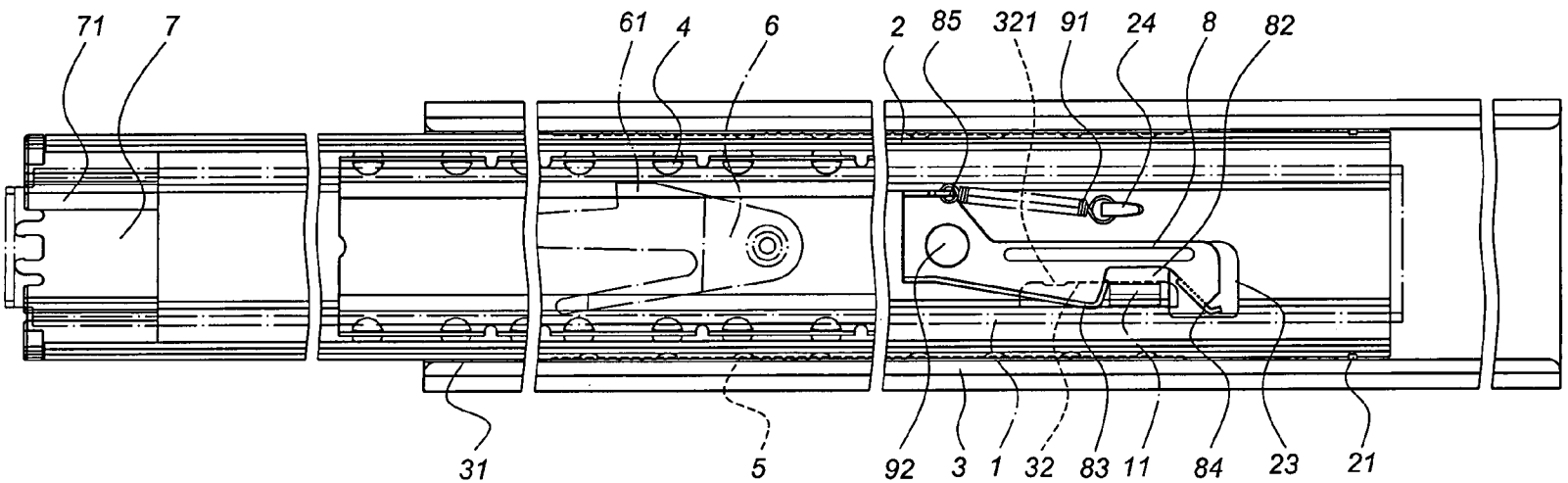
FIG. 4 is a second schematic view showing that the preferred embodiment of the present invention is pulled outwardly.
Figure 5:
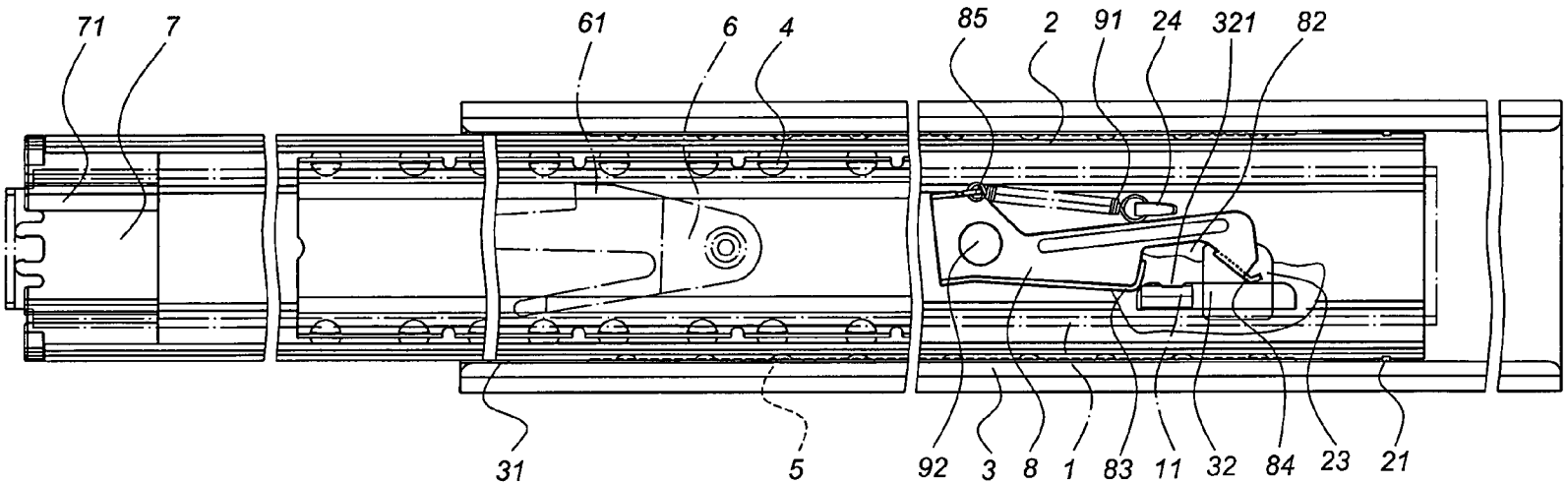
FIG. 5 is a third schematic view showing that the preferred embodiment of the present invention is pulled outwardly.
Figure 6:
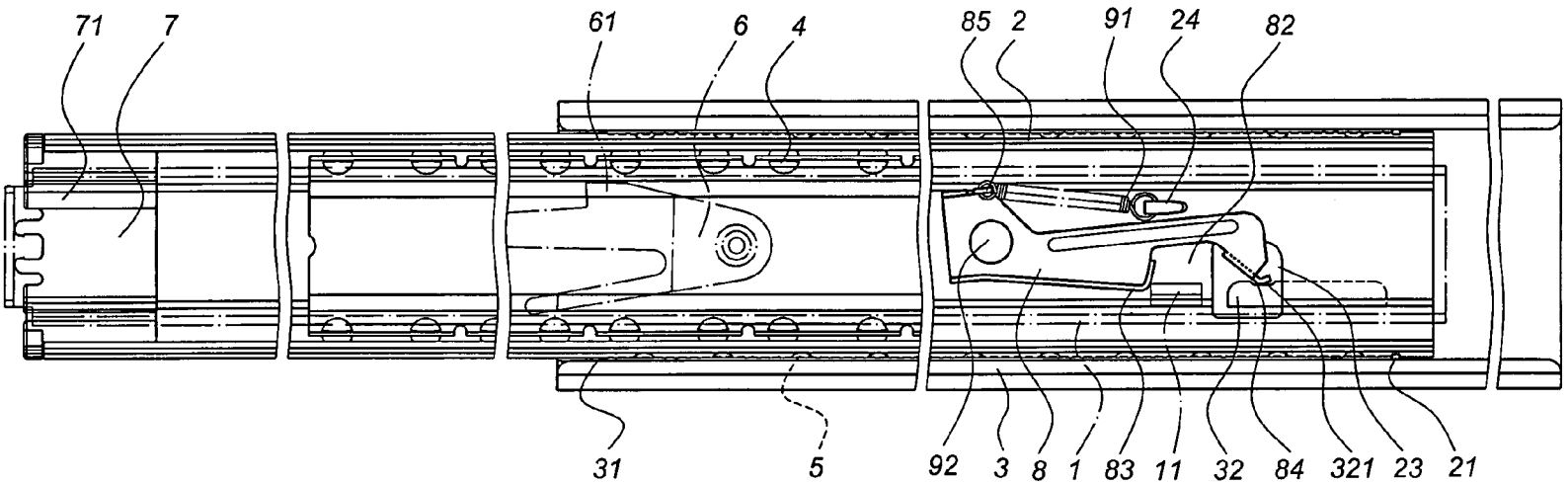
FIG. 6 is a fourth schematic view showing that the preferred embodiment of the present invention is pulled outwardly.
Figure 7:
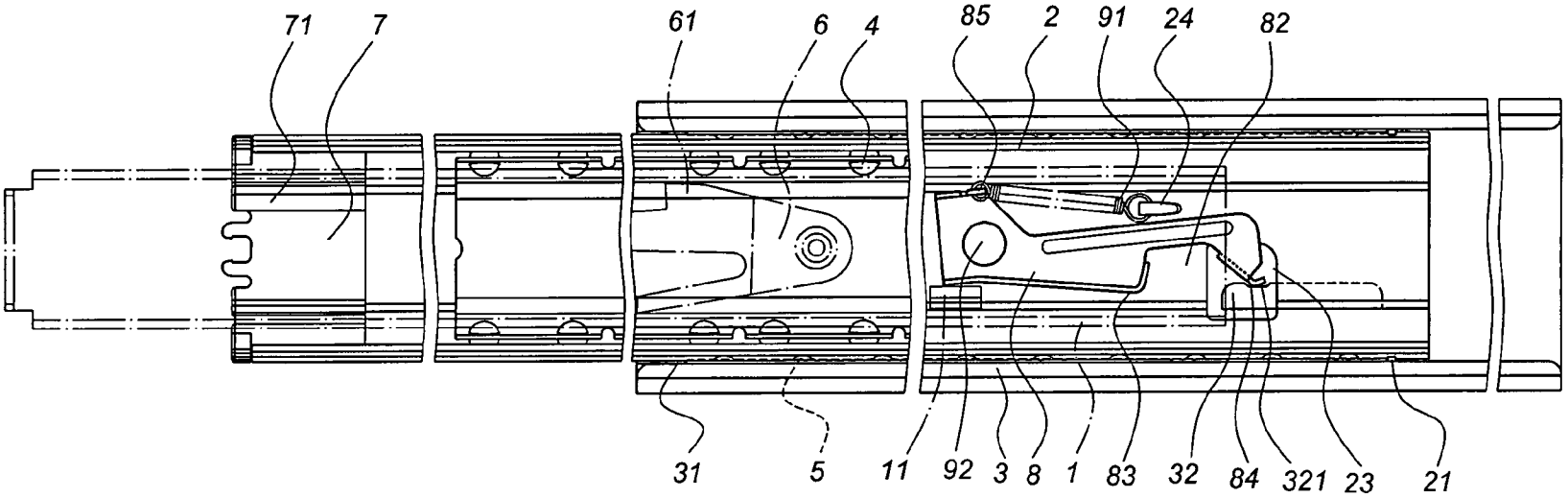
FIG. 7 is a fifth schematic view showing that the preferred embodiment of the present invention is pulled outwardly.

When the three-stage ball bearing slide is retracted as illustrated in FIG. 2, the mobile track (1) has its protruding tongue (11) extending into the indention (82) of the dancer (8) in the rear of the carrier track (2). Therefore, when the mobile track (1) is pulled and extended as illustrated in FIGS. 3 and 4, the mobile track (1) links the carrier track (2) to be pulled out by having the protruding tongue (11) to uphold the rear end of the wall (83) of the dancer (8). Once both of the mobile track (1) and the carrier track (2) are synchronously pulled out to reach the compression bit (32) of the fixed track (3) as illustrated in FIGS. 4 and 5, the dancer (8) swings by having the retaining bit (84) to climb and slide along the compression bit (32). As illustrated in FIG. 6, when the carrier track (2) extends to its extreme in relation to the fixed track (3), the retaining bit (84) of the dancer (8) falls into the shallow slot (321) at the edge of the compression bit (32) to provide a positioning function to prevent the carrier track (2) from being easily retracted in relation to the fixed track (3). The positioning strength is slightly greater than the slide resistance cast by the mobile track (1) in relation to the carrier track (2). Subsequently, the mobile track (1) is further pulled out as illustrated in FIGS. 7 and 8. The protruding tongue (11) of the mobile track (1) slightly pushes against the wall (83) of the dancer (8) before immediately disengaging from the indention (82) of the dancer (8) while the mobile track (1) is extended in relation to the carrier track (2) to finally complete the three-stage extension of the slide. According to the extension status with the mobile track (1) removed from the carrier track (2), even though the extended carrier track (2) is for the time being secured in the front end of the fixed track (3), the positioning status of having the retaining bit (84) of the dancer (8) secured in the shallow slot (321) of the compression bit (32) can be immediately released by slightly pushing in the carrier track (2), thus to retract the carrier track (2) to prevent it from becoming a sudden barrier without exercising too much efforts to pull the dancer (8).

Whereas the strength exercised to secure the retaining bit (84) of the dancer (8) into the shallow slot (321) of the compression bit (32) is slightly greater than the slide resistance of the mobile track (1) in relation to the carrier track (2) in the process of retracting the mobile track (1) once again, the mobile track (1) is first retracted into the carrier track (2) and continues to move to force the retaining bit (84) of the dancer (8) to slide out of the shallow slot (321) of the compression bit (32) to automatically release the positioning of the carrier track (2) in relation to the fixed track (3) for both of the mobile track (1) and the carrier track (2) to be gradually retracted at the same time into the fixed track (3).

Figure 10:
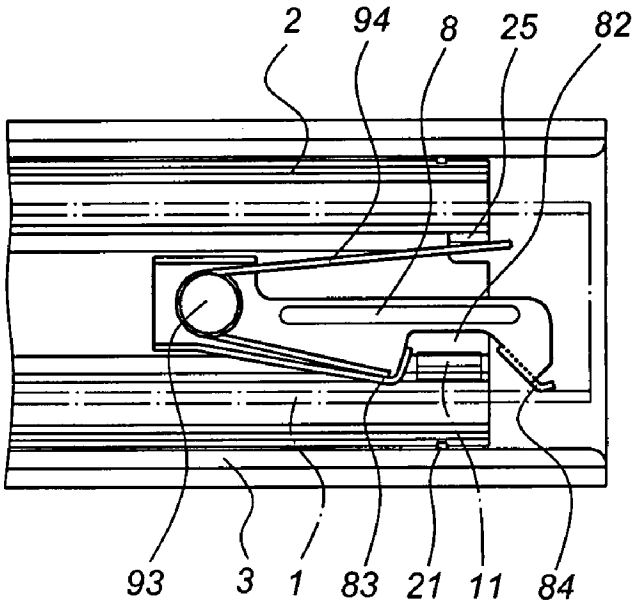
FIG. 10 is a top view showing the layout of the assembly of another preferred embodiment of the present invention.
Figure 9:
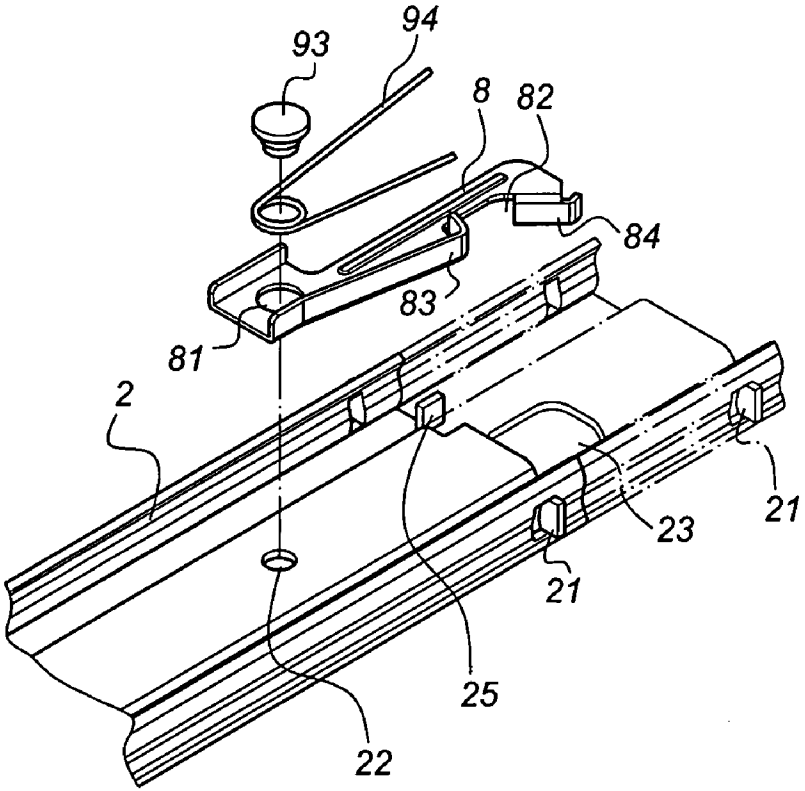
FIG. 9 is an exploded view showing another preferred embodiment of the present invention.
Figure 12:
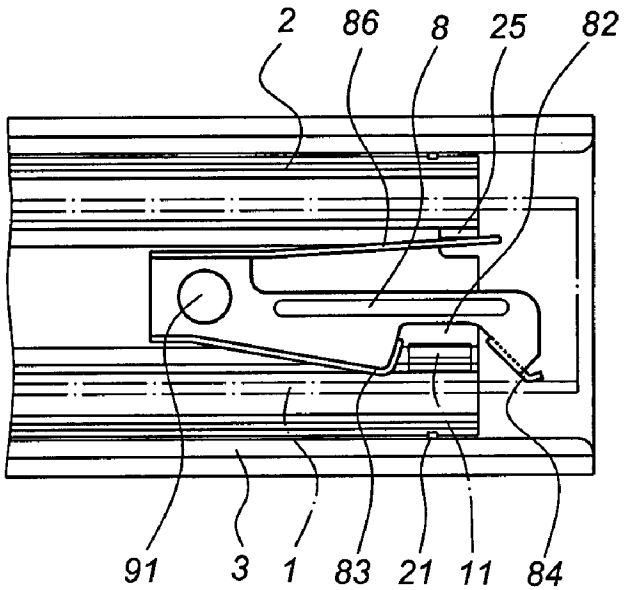
FIG. 12 is a top view showing the layout of the assembly of another preferred embodiment yet of the present invention.
Figure 11:
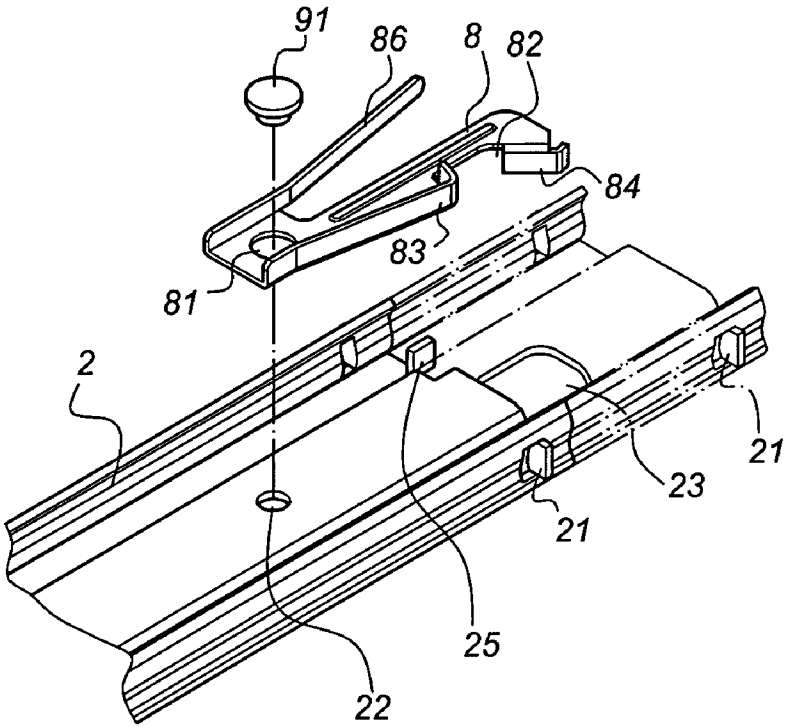
FIG. 11 is an exploded view showing another preferred embodiment yet of the present invention.
Figure 13:
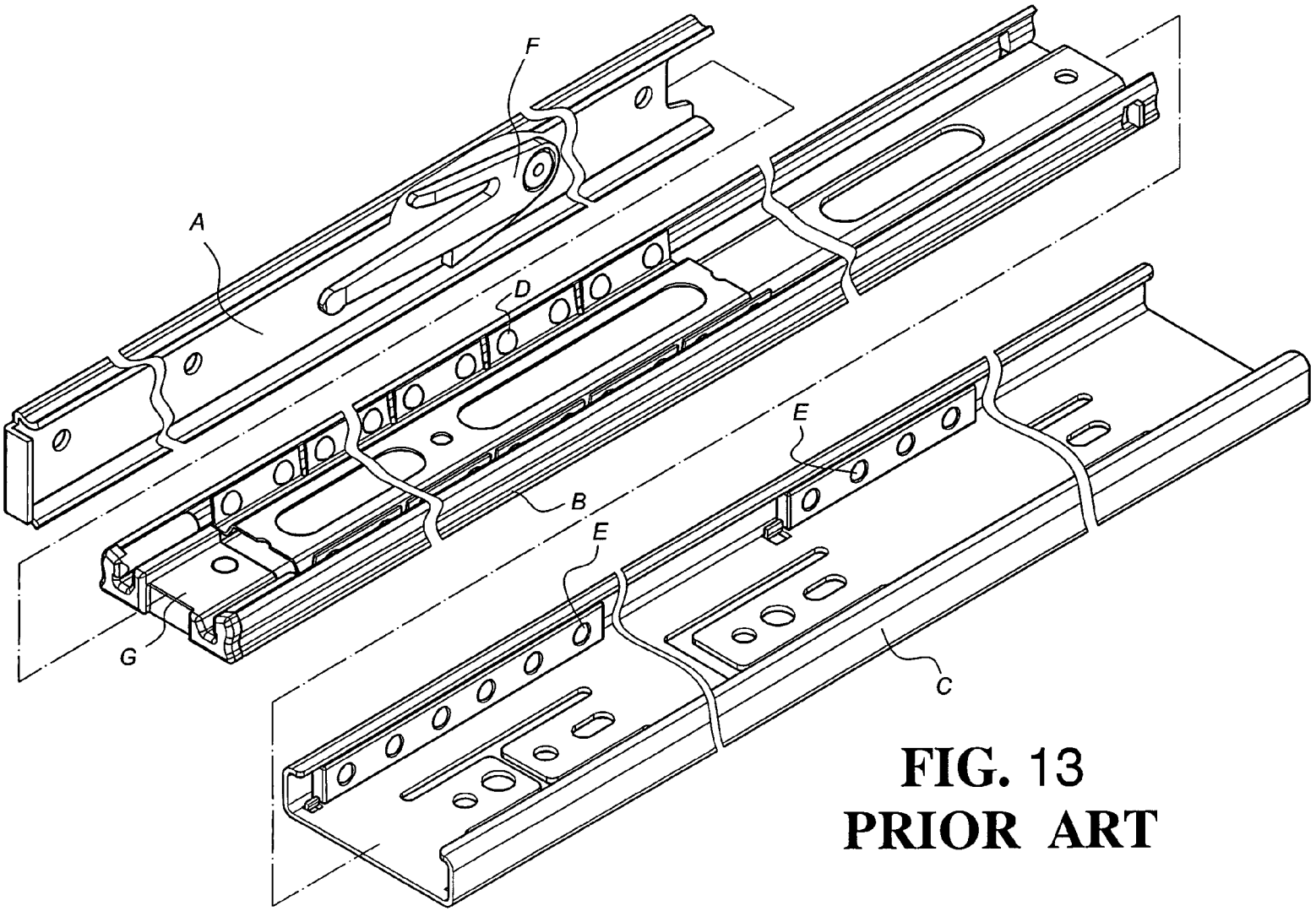
FIG. 13 PRIOR ART
FIG. 13 is an exploded view of a prior art.

Now referring to FIGS. 9 and 10 for another preferred embodiment of the present invention adapted with a dancer that automatically maintains constant elasticity from the swing, a torsion spring (94) has its coil end penetrated by an axial bolt (93) to connect the torsion spring (94) to the dancer (8), and two legs of the torsion spring (94) respectively uphold against the inner side of the wall (83) of the dancer (8) and a fixation bit (25) on the carrier track (2) to achieve the same elastic function in relation to the dancer (8). In another preferred embodiment yet of the present invention as illustrated in FIGS. 11 and 12, an elastic rod (86) is forthwith extending from one side of the pivoted end of the dancer (8). The elastic rod (86) is pressurized to uphold against the fixation bit (25) on the carrier track (2).

Furthermore, as illustrated in FIGS. 9 and 11, the rear of the carrier track (2) is properly shortened; or alternatively, the location of the dancer (8) is moved backward so that the retaining bit (84) of the dancer (8) directly extends out of the rear end of the carrier track (2) to reach the inner side of the fixed track (3) for operation in relation to the compression bit (32). In the configuration, the design of the notch (23) is not required since the rear end of the carrier track (2) is cut off at where the notch (23) is otherwise provided, and the location of the stopper (21) is properly changed.

What is claimed is:

1. A three-stage ball bearing slide and synchronous system therefore, comprising a mobile track, a carrier track and a fixed track; a slide aid being disposed between the mobile track and the carrier track and between the carrier track and the fixed track to facilitate extending the tracks, a positioning structure being disposed on the mobile track to prevent the mobile track from disengaging from the carrier track when pulled to its extreme, and the carrier track being secured when pulled to its extreme in relation to the fixed track, and characterized in that:

the carrier track having an arch center in cross-section; a dancer being pivoted to a rear end of the carrier track, the dancer having a plate flushed against the arch center of the carrier track, an indention being formed in a rear end of the plate, a wall facing an inner side of the mobile track being formed in the front of the indention, a resisting bit facing the fixed track being formed in the rear of the indention to pass through the carrier track, a rear end of the wall and a front end of the resisting bit facing each other and expanding outwardly at a certain oblique, an elastic member being connected to the carrier track, another end of the elastic member being connected to one side of a pivoted end of the dancer, the dancer being subject to an elastic pull and automatically maintaining a constant swing;

a protruding tongue being provided on the inner side of the mobile track in relation to a space defined by the indention of the dancer;

a compression bit protruding from an inner side of the fixed track in relation to the rear end of the carrier track when pulled out, an edge of the compression bit being provided with a shallow slot in relation to the resisting bit of the dancer;

the mobile track by having its protruding tongue to extend into the indention of the dancer and uphold against the wall of the dancer to link the carrier track to be pulled out; the fully extended to its extreme by the carrier track being secured by upholding with the resisting bit of the dancer engaged with the shallow slot of the compression bit on the fixed track; the positioning being immediately released when pushed by an external force on the carrier track; and the dancer being linked by the retracted mobile track to release the dancer restricted by elasticity.

2. The three-stage ball bearing slide and synchronous system of claim 1, wherein a hole is provided in a front end of the dancer to receive insertion of a bolt and riveted to a through hole disposed on the carrier track.

3. The three-stage ball bearing slide and synchronous system of claim 1, wherein a notch is provided to the rear of the carrier track to reserve the insertion of the resisting bit of the dancer to face the fixed track and operate in relation to the compression bit.

4. The three-stage ball bearing slide and synchronous system of claim 1, wherein the resisting bit of the dancer is directly extending out of the rear end of the carrier track, and further to the inner side of the fixed track to operate in relation to the compression bit.

5. The three-stage ball bearing slide and synchronous system of claim 1, wherein a hook is provided on the carrier track and a hanger is formed on one side of the pivoted end of the dancer; and two ends of the elastic member being respectively engaged with the hook and the hanger.

6. The three-stage ball bearing slide and synchronous system of claim 1, wherein a torsion spring is provided to the dancer, a hole being disposed at the front end of the dancer, the top of the torsion spring being inserted with an axial bolt, a through hole being provided on the carrier track, the dancer being pivoted to the through hole of the carrier track; two legs of the torsion spring respectively upholding the inner side of the wall of the dancer and a fixation bit of the carrier track; and the torsion spring exercising elasticity against the dancer.

7. The three-stage ball bearing slide and synchronous system of claim 1, wherein the dancer automatically swings by means of an elastic rod extending from one side of the pivoted end of the dancer, and the elastic rod being pressurized and upholding against the fixation bit on the carrier track.

* * * * *